United States Patent [19]

Waltenspühl

[11] Patent Number: 4,630,668

[45] Date of Patent: Dec. 23, 1986

[54] INTEGRAL CASTING APPARATUS FOR USE IN CONTINUOUS CASTING OF MOLTEN METAL

[75] Inventor: Rolf Waltenspühl, Zug, Switzerland

[73] Assignee: Stoping Aktiengesellschaft, Baar, Switzerland

[21] Appl. No.: 736,122

[22] Filed: May 20, 1985

[30] Foreign Application Priority Data

May 23, 1984 [CH] Switzerland ..... 2532/84

[51] Int. Cl.[4] ..... B22D 11/10

[52] U.S. Cl. ..... 164/437; 222/591

[58] Field of Search ..... 164/437, 488, 489, 53, 164/55.1, 337, 335, 473, 483, 57.1; 222/594, 629, 600, 591, 590

[56] References Cited

U.S. PATENT DOCUMENTS 3,608,621 9/1971 Bollig ..... 222/591

3,934,755 1/1976 Rheinlander ..... 222/590

FOREIGN PATENT DOCUMENTS 2394348 2/1979 France ..... 164/53

56-154269 11/1981 Japan ..... 164/437

*Primary Examiner*—Nicholas P. Godici

*Assistant Examiner*—G. M. Reid

*Attorney, Agent, or Firm*—Wenderoth, Lind & Ponack

[57] ABSTRACT

An apparatus, for use with a metallurgical vessel for the continuous casting of molten metal through a discharge opening thereof, prevents solidification of the first charge of molten metal in the discharge opening. A first overflow pipe is mounted above the discharge opening, and a second overflow pipe is mounted about the first overflow pipe and defines therewith an annular recess. Within the recess is provided a material capable of effecting the flow characteristics of the first portion of the molten material to be discharged.

22 Claims, 2 Drawing Figures

INTEGRAL CASTING APPARATUS FOR USE IN CONTINUOUS CASTING OF MOLTEN METAL

BACKGROUND OF THE INVENTION

The present invention relates to an integral casting apparatus for use with a metallurgical vessel, such as a tundish, for the continuous casting of molten metal through a discharge opening thereof. More particularly, the present invention is directed to such an apparatus including means for preventing solidification in and around the discharge opening of the first portion or charge of molten metal at the beginning of a continuous casting cycle.

In continuous casting plants or arrangements, wherein molten metal is discharged through a nozzle or discharge opening of a metallurgical vessel such as a tundish, a critical problem involves the tendency of the first portion or charge of the molten metal to solidify on or around the nozzel or discharge opening. This is due to the fact that at the beginning of a continuous casting operation, the first portion or charge of the molten metal cools on the vessel walls and at the perforated brick defining the discharge opening, since initially such elements of the vessel are less hot than the molten metal. This results in a tendency of the molten metal to "freeze" in the nozzle.

One manner of avoiding this problem in the past has been to employ burners, such as gas burners, to preheat the nozzle or discharge opening area of the vessel. This however is very expensive and time consuming. Another past attempted solution to this problem is to position an overflow pipe in the vessel above the discharge opening. By this arrangement, the melt must reach a given bath height or level before it will be allowed to pass to the discharge opening. In other words, this arrangement is intended to provide an initial, relatively large first charge of molten metal to the discharge opening, rather than a more gradual initial discharge without the overflow pipe. It has been found however that this technique is insufficient to entirely solve the problem of solidification in the discharge opening.

Additionally, it is known in metallurgical arts that there are materials which may be added to molten metal to effect the flow characteristics thereof, i.e. to make the molten metal flow easier and to counteract the tendency thereof to solidify. However, such materials have not been employed in an arrangement to satisfactorily overcome the above discussed fundamental problem of solidification of the initial portion or charge of molten metal discharged through a discharge opening in an integral, continuous casting operation.

SUMMARY OF THE INVENTION

With the above discussion in mind, it is an object of the present invention to provide an improved continuous casting arrangement whereby solidification of the initial portion or charge of molten metal in the discharge opening is prevented, or at least substantially reduced.

It is a further object of the present invention to provide an integral casting apparatus for use with a metallurgical vessel during a continuous casting operation to prevent or at least substantially reduce such solidification.

These and other objects of the present invention are achieved in accordance with the present invention by mounting above the discharge opening a first overflow pipe, and mounting about the first overflow pipe a second overflow pipe to define therebetween an annular recess. By this arrangement, molten metal to be cast from the vessel will first overflow the upper edge of the second overflow pipe into the annular recess and will accumulate therein and then overflow the upper edge of the first overflow pipe and be discharged through the discharge opening of the vessel. By this arrangement, it is possible to ensure that the initial portion or charge of molten metal is centered with the discharge opening and passes relatively rapidly therethrough, without a relatively slow trickling of the molten metal around the edges of and through the discharge opening. Additionally, in accordance with the present invention there is provided in the annular recess between the two overflow pipes a material, preferably in the form of pellets or granules, capable of effecting the flow characteristics of the first portion of the molten metal in a manner to aid in preventing solidification thereof at the discharge opening. This material exerts an influence on the flow characteristics of the molten metal precisely at the desired time, i.e. during the discharge of the first portion or jet thereof.

BRIEF DESCRIPTION OF THE DRAWINGS

The above and other objects, features and advantages of the present invention will be apparent from the following detailed description, taken with the accompanying drawings, wherein.

DETAILED DESCRIPTION OF THE INVENTION

In a continuous casting operation, the melt of molten material is first poured from a ladle into a metallurgical vessel such as a tundish, and thereafter is conducted via one or more nozzles or discharge openings in the bottom of the vessel to a continuous casting mold or molds.

Figure 1:
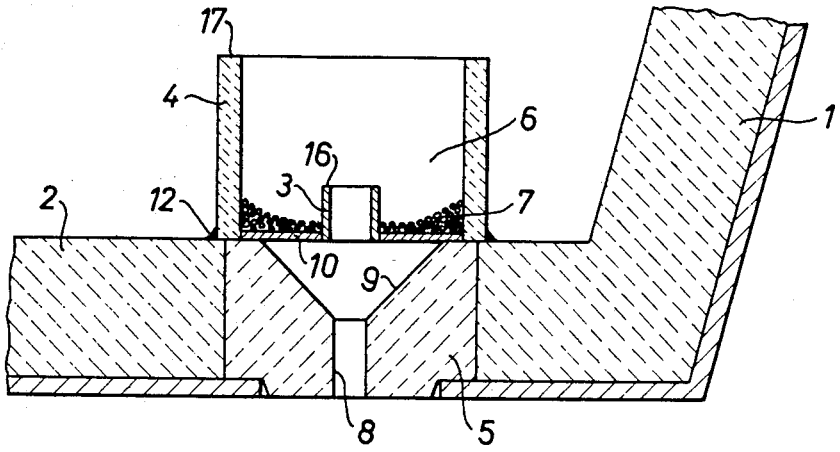
FIG. 1 is a section through an arrangement according to a first embodiment of the present invention.

Thus, in FIG. 1 is shown a tundish 1 having a bottom 2 including a perforated nozzle brick 5 having therethrough a discharge opening 8 having an inlet end 9 in the shape of a delivery funnel. In accordance with the present invention, there is provided an apparatus including an inner or first overflow pipe 3 mounted above discharge opening 9, 8 and above bottom 2 of the tundish and having an upper overflow edge 16. Pipe 3 has therethrough an opening of uniform dimensions, i.e. without restrictions. Mounted about first overflow pipe 3 is an outer or second overflow pipe 4 having an upper overflow edge 17. Preferably, the two overflow pipes 3, 4 are arranged coaxially with respect to each other and to the discharge opening 8 of perforated brick 5. Inner overflow pipe 3 is fixed at its lower end to an annular disc 10 which extends inwardly above the delivery funnel 9 of the discharge opening. Inner overflow pipe 3 has a height lower than outer overflow pipe 4. The two overflow pipes define therebetween an annular recess 6, the bottom of which is defined by annular disc 10. Disc 10 also serves to center pipes 3, 4 with respect to each other.

By this arrangement, molten metal to be cast from the interior of vessel 1 will first overflow the upper edge 17 of pipe 4 into annular recess 6 and then will overflow the upper edge 16 of inner pipe 3 and be discharged through discharge opening 9, 8. The first charge or jet of molten metal will be centered with respect to the discharge opening, and this will reduce the tendency of the first charge to solidify on the relatively cooler surfaces defining the discharge opening.

Additionally in accordance with the present invention, there is positioned in annular recess 6 a material 7, preferably in the form of granules or pellets, which is capable of effecting the flow characteristics of the first portion of molten metal to be discharged, and specifically to exert an influence on such flow characteristics tending to prevent solidification thereof during discharge. It is intended that material 7 be any such material known in the art as capable of influencing flow characteristics of a molten material such as a molten metal to prevent solidification. A particularly suitable such material has been found to be a calcium-silicon compound in the form of pellets with a grain size of up to approximately 5 mm. Such materials can be capable of undergoing exothermic reaction to raise the temperature and lower the viscosity of the initial portion of the discharged molten metal. It furthermore is believed that some such materials result in a molten mixture of the initial portion of the molten metal and molten material 7 which will have a viscosity lower than that of the melt alone. It furthermore is believed that some such materials result in a molten mixture having a liquidus temperature lower than that of the melt alone, it being kept in mind that the molten metals involved are at a relatively small degree of super heat, i.e. their temperatures are only slightly above liquidus. It is not the purpose of the present invention to provide a novel composition or manner of operation of material 7. Rather, the novelty of the present invention is intended to be the employment of known materials 7 in an annular recess 6 defined between two coaxially arranged overflow pipes 3, 4 positioned to provide an initial jet of discharged molten metal centered above the discharge opening 8 and influenced with regard to flow characteristics by the material 7 in a manner tending to reduce the tendency of the initial portion of the discharged molten material to solidify.

The first discharged portion of the molten metal will of course be mixed with the material 7 and thus will be discarded. However, the first portion of the cast strand from a continuous casting operation normally is discharged, such that this does not represent a loss. Of course, after the initial discharge through the nozzle 8, the surfaces thereof will be heated by the molten metal, such that solidification of later portions of the discharged molten metal will not occur.

Preferably, outer overflow pipe 4 is formed of a refractory material. However, inner overflow pipe 3 and annular disc 10 may be formed of a metal material such as a suitable steel.

The lower end of outer overflow pipe 4 is connected to the container bottom 2 by means of a connection 12, for example a refractory cement, which is destroyed, i.e. is melted or dissolved, under the effects of the heat or of the buoyancy of the melt after a relatively short period of time, for example by the end of the integral casting operation. In other words, it is not necessary for the apparatus of the present invention to be permanently connected to the bottom 2 of the vessel. Rather, the apparatus of the present invention need be positioned thereat only for a sufficient length of time to ensure the prevention of solidification of the initial discharged portion of the molten material.

Figure 2:
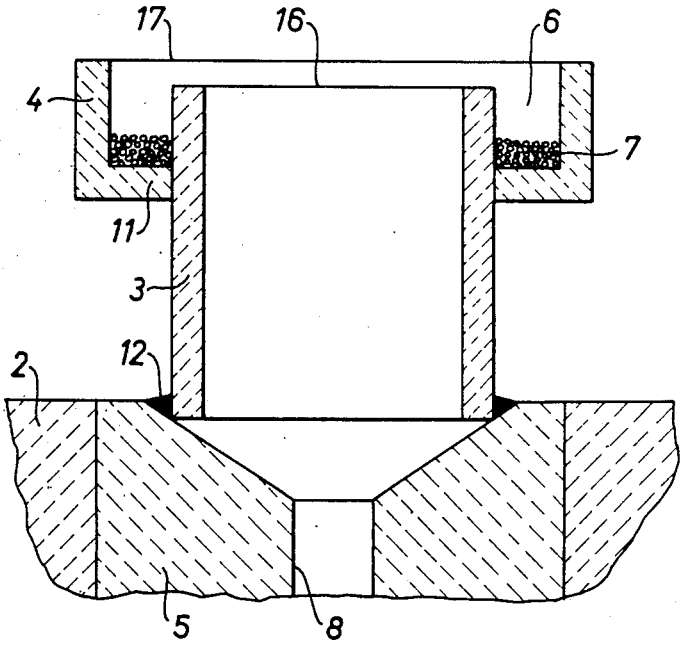
FIG. 2 is a section through an arrangement according to a second embodiment of the present invention.

In the embodiment of FIG. 2, the inner overflow pipe 3 is connected to the bottom 2 by a breakable connection 12, of the type described above. In the specifically illustrated arrangement, such connection occurs at the inlet of the funnel portion of the discharge opening. The outer overflow pipe 4 has extending radially inwardly thereof a bottom wall 11 which is fixed directly to the exterior of the inner overflow pipe 3 to form the bottom of annular recess 6. This connection preferably is at a position above the mid-height of the inner overflow pipe 3. In this embodiment, both pipes 3, 4 are formed of refractory material. The apparatus of the embodiment of FIG. 2 otherwise operates in the same manner as the above described embodiment of FIG. 1.

The upper edge 17 of the outer overflow pipe 4 preferably is provided at a level above the overflow edge 16 of the inner overflow pipe 3. However, it is intended to be within the scope of the present invention to position overflow edge 17 at the same height or even below the height of overflow edge 16.

Instead of a single nozzle or discharge opening 9, 8, the bottom 2 of the vessel can be provided with a plurality of such nozzles, each of which is provided with an apparatus in accordance with the present invention. Furthermore, it is intended that the present invention be applicable to so-called free-run nozzles or to nozzles that cooperate with controllable gates, for example sliding gates or sliding closure units, fitted below the nozzle at the container bottom.

The integral casting apparatus of the present invention is mounted above the discharge opening or nozzle as the tundish or vessel is being prepared for a pouring operation. At the start of pouring, the melt first will rise above the container bottom outside the outer pipe 4 until the bath level reaches the overflow edge 17 of outer pipe 4, and then will flow into annular recess 6. Thereat, the material 7 is brought into action to influence the flow characteristics of the melt such that the first portion or charge of the melt that overflows the edge 16 of inner pipe 3 will flow directly into nozzle 8, being centered with respect thereto by inner pipe 3. It will be apparent that those skilled in the art will be able to appropriately dimension the cross section and heights of the two pipes to achieve these desired results for a given installation and a given set of operating conditions.

Although the present invention has been described and illustrated with respect to preferred embodiments thereof, it is to be understood that various modifications and changes may be made to the specifically described and illustrated features without departing from the scope of the present invention.

I claim:

1. In a continuous casting arrangement of the type wherein molten metal is discharged from a metallurgical vessel through a discharge opening in a bottom thereof, the improvement of means for preventing the molten metal from solidifying in said discharge opening at the beginning of a casting operation, said means comprising:

a first overflow pipe mounted above said discharge opening and extending above said bottom of said vessel;

a second overflow pipe mounted about said first overflow pipe and defining therewith an annular recess;

whereby molten metal to be cast from said vessel first overflows the upper edge of said second overflow pipe into said annular recess and then overflows the upper edge of said first overflow pipe and is discharged through said discharge opening; and said annular recess having therein a material capable of effecting the flow characteristics of the first portion of molten metal to be discharged through said discharge opening.

2. The improvement claimed in claim 1, wherein said upper edge of said second overflow pipe is at a level higher than said upper edge of said first overflow pipe.

3. The improvement claimed in claim 1, wherein the lower end of said second overflow pipe is connected to the bottom of said vessel by a connection capable of being destroyed by the melt.

4. The improvement claimed in claim 1, wherein said second overflow pipe has a greater wall thickness than said first overflow pipe.

5. The improvement claimed in claim 1, wherein said first and second overflow pipes are arranged coaxially with respect to each other.

6. The improvement claimed in claim 1, further comprising an annular disc forming the bottom of said annular recess and connected to the lower end of at least one said overflow pipe.

7. The improvement claimed in claim 6, wherein said first overflow pipe is connected at said lower end thereof to said annular disc, and said second overflow pipe is connected at the lower end thereof to the bottom of said vessel.

8. The improvement claimed in claim 7, wherein said first overflow pipe and said annular disc are formed of a metal material, and said second overflow pipe is formed of a refractory material.

9. The improvement claimed in claim 1, wherein said second overflow pipe has an inwardly extending annular bottom wall fixed directly to the exterior of said first overflow pipe and forming the bottom of said annular recess.

10. The improvement claimed in claim 9, wherein said bottom wall is fixed to said first overflow pipe at a position above the mid-height thereof.

11. An apparatus, for use with a metallurgical vessel for the continuous casting of molten metal through a discharge opening in a bottom thereof, for preventing solidification of the molten metal in the discharge opening at the beginning of a casting operation, said apparatus comprising:

a first overflow pipe adapted to be mounted above the discharge opening to extend above the bottom of the vessel; and a second overflow pipe mounted about said first overflow pipe and defining therewith an annular recess;

whereby molten metal to be cast from the vessel is adapted to first overflow the upper edge of said second overflow pipe into said annular recess and then to overflow the upper edge of said first overflow pipe to be discharged through the discharge opening of the vessel.

12. An apparatus as claimed in claim 11, wherein said annular recess has therein a material capable of effecting the flow characteristics of the first portion of molten material to be discharged.

13. An apparatus as claimed in claim 11, wherein said upper edge of said second overflow pipe is at a level higher than said upper edge of said first overflow pipe.

14. An apparatus as claimed in claim 11, wherein said second overflow pipe has a greater wall thickness than said first overflow pipe.

15. An apparatus as claimed in claim 11, wherein said first and second overflow pipes are arranged coaxially with respect to each other.

16. An apparatus as claimed in claim 11, further comprising an annular disc forming the bottom of said annular recess and connected to the lower end of at least one said overflow pipe.

17. An apparatus as claimed in claim 16, wherein said first overflow pipe is connected at said lower end thereof to said annular disc.

18. An apparatus as claimed in claim 17, wherein said first overflow pipe and said annular disc are formed of a metal material, and said second overflow pipe is formed of a refractory material.

19. An apparatus as claimed in claim 11, wherein said second overflow pipe has an inwardly extending annular bottom wall fixed directly to the exterior of said first overflow pipe and forming the bottom of said annular recess.

20. An apparatus as claimed in claim 19, wherein said bottom wall is fixed to said first overflow pipe at a position above the mid-height thereof.

21. The improvement claimed in claim 1, wherein said first overflow pipe has therethrough an opening of uniform dimensions.

22. An apparatus as claimed in claim 11, wherein said first overflow pipe has therethrough an opening of uniform dimensions.

* * * * *